United States Patent [19]

Freeman et al.

[11] 4,166,428

[45] Sep. 4, 1979

[54] INTRUDER ALARM

[75] Inventors: John D. Freeman, Westport; David E. Earls, Norwalk, both of Conn.; Edward F. Cielaszyk, Oglesby, Ill.

[73] Assignee: General Time Corporation, Thomaston, Conn.

[21] Appl. No.: 904,262

[22] Filed: May 9, 1978

[51] Int. Cl.[2] ..... G08B 13/08

[52] U.S. Cl. ..... 116/86; 116/112; 222/39

[58] Field of Search ..... 116/85, 86, 77, 112; 222/5, 39, 81.5

[56] References Cited

U.S. PATENT DOCUMENTS

| | | | |
|---|---|---|---|
| 3,091,365 | 5/1963 | Horner et al. | 222/5 |
| 3,247,824 | 4/1966 | Rodgers | 116/114 PV |
| 3,352,456 | 11/1967 | Swineford | 222/5 |
| 3,512,499 | 5/1970 | Runde et al. | 116/129 R |
| 3,690,286 | 9/1972 | Gantt | 116/86 |

*Primary Examiner*—Daniel M. Yasich
*Attorney, Agent, or Firm*—Pennie & Edmonds

[57] ABSTRACT

An intruder alarm security device includes a source of fluid under pressure which serves as a medium for oscillating a diaphragm at the throat of a horn to create an audible warning signal. The intruder alarm includes an actuator, a plunger assembly and connecting structure for coupling rotary movement of the actuator to longitudinal movement of the plunger assembly to open communication between the diaphragm and the source of fluid. The or connecting coupling structure includes a lost motion connection so that the plunger assembly is controlled by the actuator only to the point of opening the communication. And, the plunger assembly includes an orifice member for metering the flow of medium to the diaphragm, yet, first is capable of allowing any entrained particulate from a closure of the source to clear the device.

14 Claims, 13 Drawing Figures

INTRUDER ALARM

BACKGROUND OF THE INVENTION

1. Field of the Invention

The present invention relates to an intruder alarm security device of the type which generates a signal such as an audible signal in response to unauthorized entry to a secured area. The device has particular application for use at a window or door comprising a barrier to the secured area.

2. Discussion of the Prior Art

The prior art is replete with alarm devices which are adapted to be used at a door or window barrier to a secured area and which provide an alarm to indicate an unauthorized entry to the secured area through a barrier. The prior art has developed from very early devices wherein an alarm was sounded by the closing of a circuit to a bell and the release of a spring wound motor causing a bell to sound. See, for example, the patents to B. S. Bell (U.S. Pat. No. 828,834) and A. Zukor (U.S. Pat. No. 1,453,058), respectively.

More recently, alarm devices have developed in the prior art that utilize, generally, a container of a pressurized fluid, a signalling device in the form of an air horn, and an actuating mechanism for opening communication between the pressurized fluid and the air horn to sound are audible alarm. These alarm devices include the following representative known U.S. Pat. Nos:

3,325,800 to W. C. Messick
3,451,369 to N. I. Leve et al
3,659,549 to W. Wagner
3,690,286 to K. T. Gantt
3,695,212 to K. T. Gantt
3,804,053 to J. R. Gray et al
4,024,830 to C. P. Fegley et al
4,024,986 to C. R. Fegley et al The foregoing alarm devices referring to the general teaching, above, are substantially similar and, aside from the Messick, Leve et al and Wagner patents, the patents relate to alarm devices adapted to use with a door and/or window to provide an alarm upon an unauthorized entry.

The Fegley et al ('830) patent which overall is representative of the above patents further describes a handle or trigger element which is adapted to be moved in response to movement of the movable part of a door, window or movement of some other object. Movement results in release of a spring biased actuating member and the actuating member moves a container having a pressurized fluid toward a piercing point. The piercing point punctures a seal of the container to release fluid for flow to the horn.

While the alarm devices known to the art provide the function of sounding a horn to provide an audible signal as a result of an unauthorized entry to a secured area, or to the vending machine of the Messick patent, for example, the alarm devices of the art are relatively complex in construction and they require cords, etc. to connect the handle or trigger element to the window or other object, or an elaborate biasing arrangement for the handle or trigger element in the use of the alarm device with a door. Importantly, however, the alarm devices of the prior art do not provide for operation which may be characterized as "failsafe". By this, it is meant that the prior art devices either may be "teased" operative thereby to prevent a sufficient pressure build-up within the region of the horn over the period of escape of the fluid from the container for a sounding of the alarm or that the sounding of the alarm may be muffled or muted and thereby not discernible by those prepared to hear the signal. Further, the alarm devices of the art do not provide a metering structure which, first, is capable of permitting entrained particulate material from the closure of the container to clear the device and not block the flow and, second, after only a few milliseconds time, to meter the flow of fluid to extend the period over which the signal is sounded.

SUMMARY OF THE INVENTION

The intruder alarm signaling device of the present invention is one of low cost, capable of being easily installed at a barrier such as a door or window of an area thereby to provide perimeter security, and one through "failsafe" operation provides an audible alarm signal when actuated by an unauthorized opening of a door or window.

The device of the present invention includes a source of fluid under pressure, a horn including a diaphragm adapted to oscillate which is in communication with the source, and actuated structure for opening the communication between the source and horn for causing the diaphragm to oscillate and develop an audible signal. The actuated structure includes an assembly movable from a first position, an actuator adapted for movement rotationally and means for converting the rotary movement of the actuator to longitudinal movement of the assembly. The converting means includes a lost motion connection whereby the assembly is directly controlled in movement from the first position to open the communication yet capable of retracting rapidly solely under control of the fluid emerging from the container. The assembly includes an orifice having the dual function of allowing particulate material entrained with the fluid to clear the device before metering the fluid and, thereafter, of metering the fluid to perpetuate the alarm signal over a desired time frame. The device also includes a cage formed by a plurality of ribs at the horn to prevent or substantially eliminate the possibility of the alarm signal being muffled or muted so as to not be perceived by persons in the vicinity of the transmission. By provision of a heat sink in contact with the container of fluid under pressure the likelihood of the contents freezing upon vaporization is materially reduced.

These and other objects and advantages of the present invention will be understood from the accompanying drawing and description and the essential features thereof will be set forth in the appended claims.

DESCRIPTION OF THE PREFERRED EMBODIMENT

Figures 1, 10:
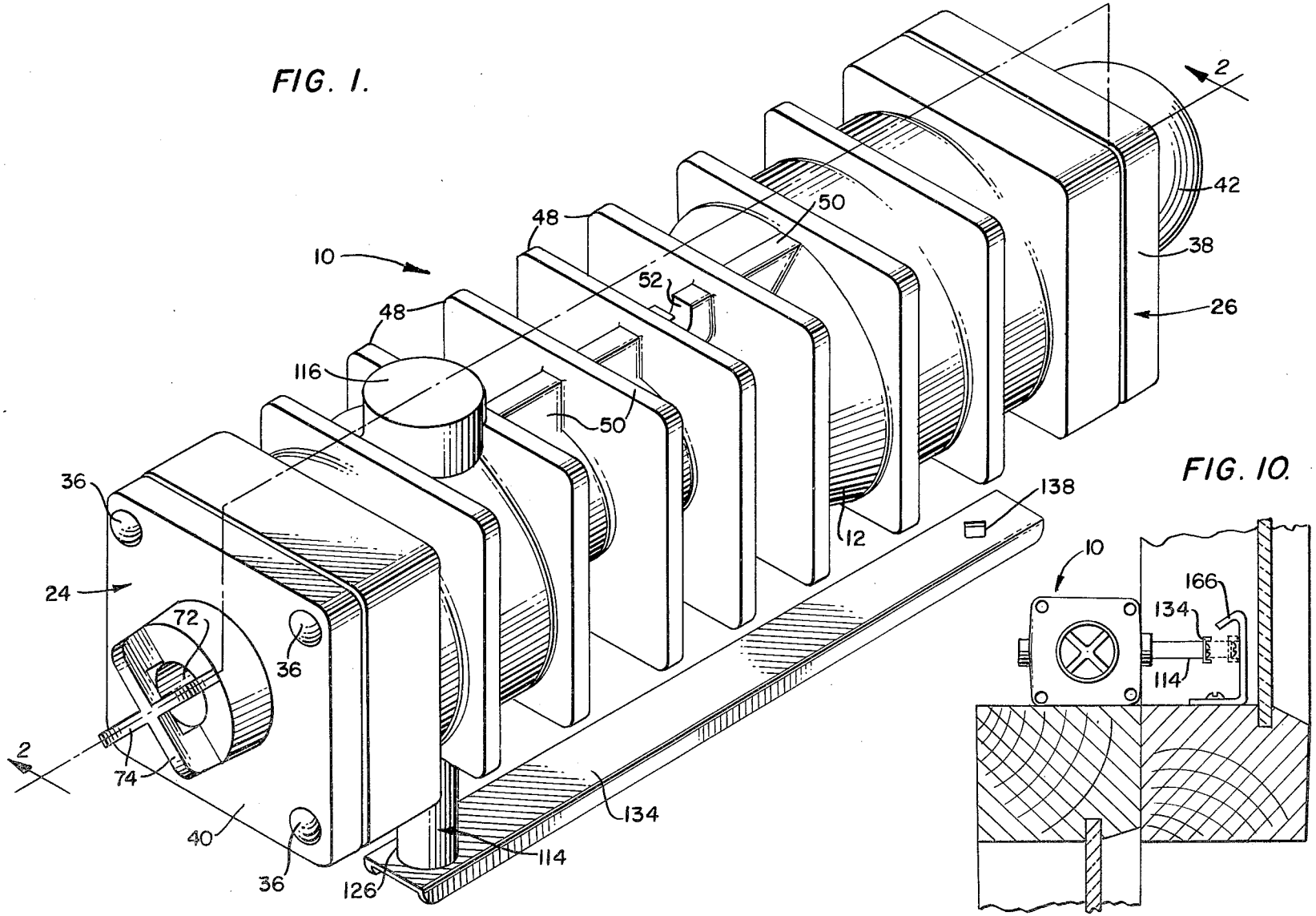
FIG. 1 is a view in perspective of the intruder alarm of the present invention.
Figure 9:
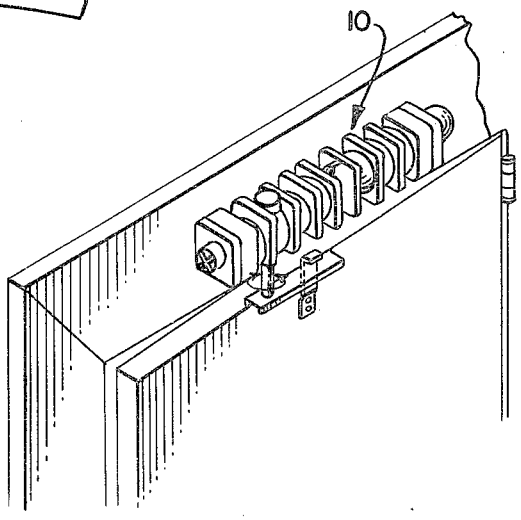
FIG. 9 is a schematic presentation of the intruder alarm mounted at the top of a door frame with the operating handle located in position thereby to be actuated when the door is opened during an unauthorized entry; and, FIG. 10 is a view similar to that of FIG. 9, the intruder alarm, however, being positioned so that the operating handle is actuated upon relative movement of the upper and lower members of a double-hung window during an unauthorized entry.

The intruder alarm 10 of the present invention is particularly adapted for use at the points of entry to a secured area so that when armed and there shall be an unauthorized entry, it provides an alarm which preferably is an audible alarm. For example, the intruder alarm may be used in conjunction with a window, such as the double-hung window as illustrated in FIG. 10 or with a door as illustrated in FIG. 9 and actuated upon movement of a movable part of the door or window relative to a stationary part. The intruder alarm, also, may be used together with a trip wire whereby it may be actuated by unauthorized persons on the premises.

The intruder alarm is formed by a housing 12, the wall of which defines an opening extending along the longitudinal axis from one end of the housing to the other. Between the ends of the housing, the opening provides a flow passage for fluid adapted to be released from a confined source of fluid including, in fluid flow direction, a port 16, an intermediate length 18 and an end length 20. The port and the intermediate length are circular and the intermediate length is of a diameter larger than that of the port. An inwardly tapered surface 22 is formed at the junction of the end and intermediate lengths of the flow passage for ease in receipt of a plunger assembly, to be described, into the intermediate length.

A horn 24 forming a part of sound generating structure, to be described below, provides a closure for the end length at the downstream end of housing 12. The opposite end of the housing is closed by a cap 26 having an internal recess 28 which conforms substantially to the end wall of a container 30. The container provides a closure for a medium such as Freon, carbon dioxide, fluorochloromethane, fluorochloroethane, among others which are capable of being stored in a pressurized state and which when released flow as a gas toward the sound generating structure. Many of these are readily available in the consumer market and a container of carbon dioxide has been used successfully. Because of the relatively low cost and long shelf life of containerized carbon dioxide it is preferred.

The housing to accommodate the container 30 (see FIGS. 2 and 3) includes a length 32 generally a cylindrical outline to receive a substantial length of the container and a length 34 having a tapered portion and a neck into which the end of the container is received.

Both the cap 26 and the horn 24 are releaseably received at the respective ends of the housing 12. Any particular manner or means of receipt as are known in the art, such as a plurality of screws 36 which are received through the horn and cap (the screws through the cap are not shown) and threaded into tapped holes matingly positioned in the end of the housing may be employed. Both the cap and the horn include a base portion 38 and 40, respectively, of rectangular outline and the ends of the housing 12, likewise, are of rectangular outline. Further, the ends are coextensive with the member which it receives. The flat peripheral walls of the members and the housing ends lend positional stability for the intruder alarm when mounted, for example, on the upper surface of the lower frame or sash of the double-hung window of FIG. 10 or on the top frame of the door of FIG. 9.

The cap includes a dome-shaped projection 42 comprising the wall of recess 28 serving as a socket into which container 30 is received. The cap provides a mounting for the container on the housing and when received the end of the container will be adjacent the opening to port 16. Actually, the end of the container is disposed against a seal 44 juxtaposed to the wall around the port. The seal 44 as is a seal 46 disposed between the end of the housing and the cap are annular in outline and are preferably formed of a compressible material such as neoprene. The seals provide a tight engagement of parts in the assembled orientation and substantially assure that the gas flows through the flow passage. The housing and cap may be attached in any suitable manner.

The wall of the housing is irregularly shaped and supports a plurality of ribs 48 (see FIG. 1). The ribs are rectangular, coextensive with the base portions 38 and 40 and spaced along the wall. A plurality of web members 50 extend between several adjacent pairs of ribs. The web members are disposed at diametrically opposed locations across the housing and together with the ribs provide structural support and rigidity to the housing. At least one of the web members on each side of the housing is provided with a cut-out 52 of U-shaped outline for purposes of mounting the intruder alarm in the locations heretofore described. To this end, a screw may be received into each of the cut-outs and threaded into the member upon which the intruder alarm is to be supported.

Figure 2:
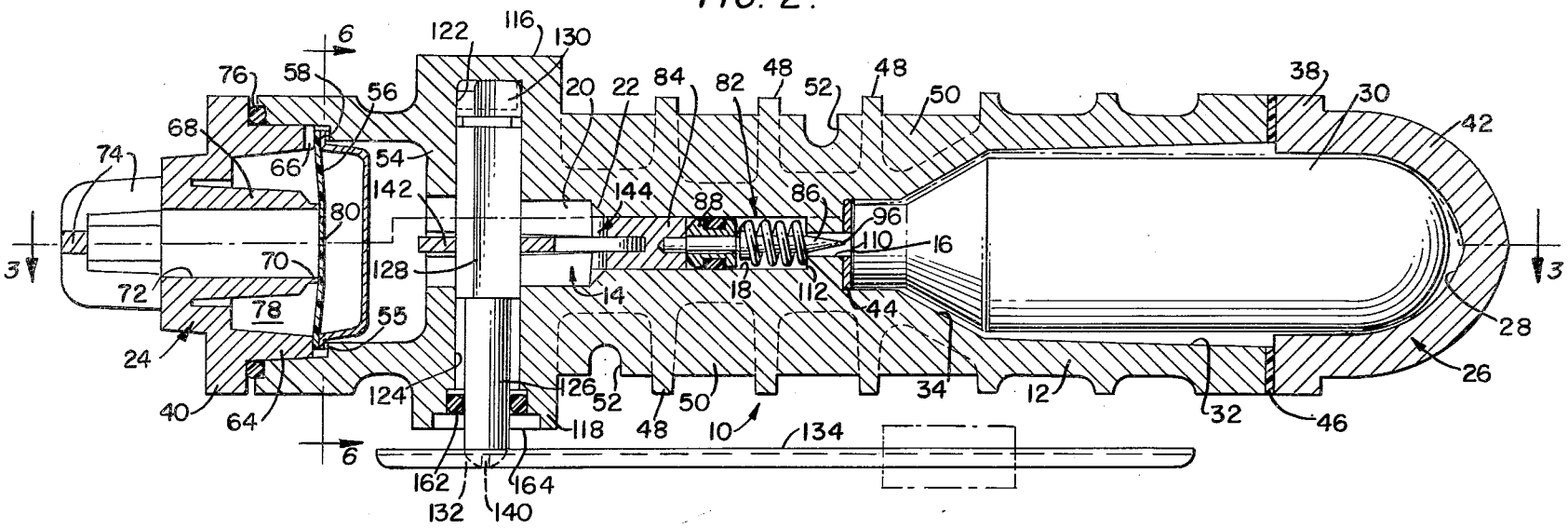
FIG. 2 is a view in section as seen along the line 2—2 in FIG. 1.
Figure 7:
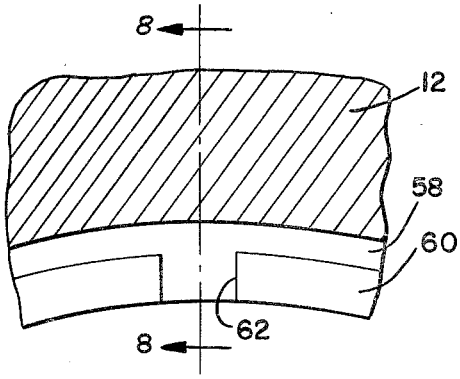
FIG. 7 is a partial view of the sidewall of the housing illustrating a path for fluid flow into an alarm sounding chamber.
Figure 8:
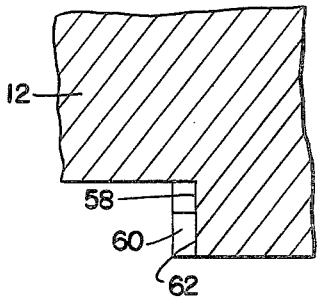
FIG. 8 is a view in section as seen along the line 8—8 in FIG. 7.

The sound generating structure includes a resonating chamber 54, a diaphragm 56 and the horn 24 which serves, additionally, as a mounting structure for mounting both the resonating chamber and the diaphragm at the downstream end of housing 12. The resonating chamber is cup-shape in outline including an outwardly directed annular lip 55. The resonating chamber may be formed of cold rolled strip steel or the equivalent, provided with a nickel plate finish and may be of about $0.025 \pm 0.001$ inch in cross-section. An annular shoulder 58 is formed somewhat upstream of the downstream end of the housing and a rib 60 is carried by the shoulder. The rib is disposed toward the longitudinal axis thereby to provide an annular opening between the rib and the wall of the housing. At least one cut-out 62 and preferably a plurality of cut-outs which may be arranged at 90° spacing are provided in the rib (see FIGS. 7 and 8) to permit flow of fluid along the flow passage to enter into the area of the sound generating structure. As illustrated in FIG. 2, for example, the resonating chamber 54 is supported on the rib 60 and the diaphragm 56, in turn, is supported on the lip 55 of the resonating chamber. Both the resonating chamber and the diaphragm are of a diameter so as to not occlude the annular opening between the rib and the wall of housing 12.

The horn 24 includes a cylindrical portion 64 which extends from the base portion 40. When the horn is received at the downstream end of the housing, the end of the cylindrical portion abuts against the peripheral region of diaphragm 56 thereby to secure both the diaphragm and the resonating chamber in the position heretofore described. At least one cut-out 66 is provided in the end of the cylindrical portion thereby to complete the flow passage for the flow of fluid into the area of the sound generating structure. A second cylindrical portion 68 having a necked down end 70 also extends from the base portion 40 concentrically inwardly of the cylindrical portion 64. A passage 72 is provided within the cylindrical portion 68 thereby to pass the fluid flowing in the flow passage from the intruder alarm to the atmosphere. A plurality of ribs 74 which may be arranged in a cruciform pattern are carried by the horn 24 at the end of passage 72. The ribs make it difficult if not impossible to close the passage for purposes of muffling or muting or completely eliminating the audible warning signal which is generated. An O-ring 76 is received around the cylindrical portion 64 to reside in a mounted relation between the base portion 40 and the end of housing 12. The O-ring provides a seal for the plenum chamber 78. As may be appreciated, the length of passage 72 and the size of the opening through the horn in substantial part determines the frequency of the audible warning signal generated by the intruder alarm. The frequency of the audible warning signal also will be dependent upon the material, thickness and the vibratory movement of the diaphragm 56. In the preferred embodiment, the diaphragm is formed of Mylar and may be of a thickness of approximately 0.0030 inch. The flow of fluid into the plenum chamber 78 and the pressure therein which should be about at least 2–4 lbs/in$^2$ results in a vibrating action of the diaphragm with respect to the necked down end 70. The vibration of the diaphragm is enhanced by provision of a vent-hole 80 in a location along the axis of passage 72. The vent-hole, thus, prevents a pressure build-up behind the diaphragm. In practice, the pressure in the plenum chamber has been slightly in excess of the value heretofore mentioned as required for operation. Thus, a pressure drop of many fold is obtained through the flow passage to the plenum chamber when it is recognized that the pressure of the source is in the range of about 1500 to about 2000 lbs/in$^2$.

The plunger assembly 82 includes a plunger head 84, a plunger pin 86 and an orifice member 88. As perhaps seen to best advantage in FIGS. 4 and 5, the plunger head is formed by a rod-like body having a central bore 90 and a pair of cuts 92 and 94 at one end. The cuts are perpendicular and extend toward the bore from the downstream end of the body. The cut 92 is rectangular in outline and extends to a depth greater than that of the cut 94. The plunger pin 86, also, is generally rod-like in outline having a tip 96 at one end. The other end of the plunger pin is of a dimension somewhat reduced from that of the remainder of the rod. The reduced end is received into bore 90 by a friction fit so that the plunger pin and plunger head are movable conjointly. The assembly of the plunger head and the plunger pin should be capable of withstanding a static axial unseating load of approximately 20 pounds force. The orifice member 88, as illustrated in the Figures, is received on the plunger pin between a shoulder 98 and the upstream face of the plunger head. The orifice is generally spool-like in outline including a pair of flanges 100 and 102 on either side of a cut-out 104. The upstream flange 100, as determined by the direction of fluid flow in the flow passage, includes a flat face and the downstream flange is truncated in section thereby to provide an annular surface having substantially less confronting surface area than that of the downstream flange overall for abutting against the plunger head in one position of the orifice member 88. An orifice 106 in the form of a V-shaped notch is formed through the truncated portion of the downstream flange. The bore of orifice member 88 is somewhat larger than the outer diameter of plunger pin 86 upon which it is received and by the provision of an O-ring 108 received in cut-out 104 a seal may be created between the orifice member and the inner wall of the intermediate length thereby to provide that all of the fluid flows in annular pattern around the plunger pin and through orifice 106.

The plunger assembly is received in the intermediate length 18 of opening 14 in a manner such that the tip 96 of plunger pin 86 is disposed both within port 16 and closely adjacent a closure 110 of container 30. A spring 112 which may be a helical compression spring is received around the plunger pin and seated between the wall of the housing surrounding port 16 and the orifice member to bias it and the plunger assembly in the downstream direction. The spring provides only a small compressive force and primarily serves to orient the structure in their non-operative position.

Figure 4:
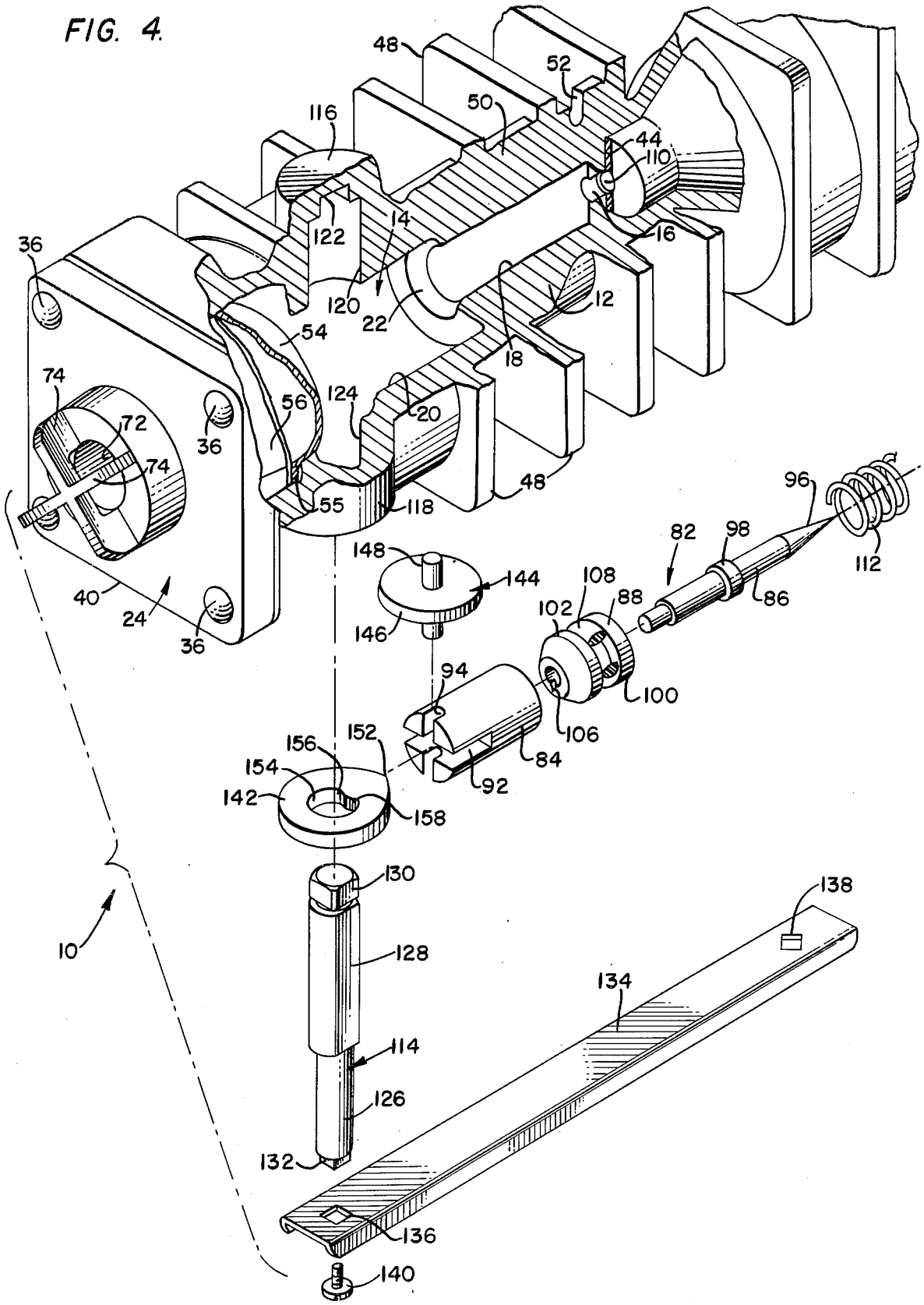
FIG. 4 is a partial view of the housing of the intruder alarm with a portion of the sidewall broken away and various operative components exploded therefrom.

As may also be seen in FIG. 4, a shaft 114 is received into the housing 12. As will be discussed hereafter, the shaft is the actuating member and both movable along its longitudinal axis from a first position to a second position and rotationally about its axis when located in the second position. Movement of the shaft to the second position will enable or permit operation of the intruder alarm and when the shaft is in the first position the intruder alarm is disabled.

The housing includes a pair of bosses 116 and 118 disposed in diametrically opposed relation within the region of the end length 20 of the flow passage through opening 14. More particularly, the boss 116 includes a bore 120 partially therethrough which terminates in a socket 122 of non-circular outline. The boss 118 includes a bore 124 for receipt of the shaft therethrough.

As perhaps best seen in FIG. 4, the shaft 114 includes a length 126 of circular cross-section and a length 128 of D-shaped cross-section. An extension 130 is carried at one end of the shaft and an extension 132 is carried at the other end of the shaft. Both of the extensions are non-circular in cross-section and the extension 130 is of an outline complementary to the outline of the socket 122. Thus, when the shaft 114 is in the first axial position, the extension 130 will extend into the socket 122 and movement rotationally about the longitudinal axis will be prevented. The extension 132 may have a polygonal cross-section, such as a square and in this manner provide a plurality of four (4) positions of receipt of an arm 134 including an opening 136 of complementary outline at one end. The arm may be of any particular cross-section such as that illustrated in FIG. 4 and for purposes of providing an additional plurality of mounting dispositions of the arm on the shaft a further opening 138 of like outline although rotated through an angle of 45° may be formed at the other end of the arm. The arm may be received on the shaft in any particular manner as known in the art such as by means of a screw 140 capable of being threadedly received in a tapped bore in the extension 132. The screw may be threaded down upon a washer (not shown) thereby to obtain a tight engagement.

For long life and durability in operation, the shaft may be formed of high carbon steel and the arm may be formed of cold roll steel which, additionally, may be nickel plated.

Rotational movement of the shaft about its longitudinal axis depicted by the arrow in FIG. 9 results in translation of the plunger assembly toward closure 110 of container 30. This movement, imparted by arm 134 and coupled to the plunger assembly by a connected structure, is in opposition to the small biasing force of spring 112 and results in the opening of communication between the pressurized fluid in container 30 and the flow passage to the plenum chamber 78 of the sound generating structure.

The connecting structure includes a cam 142 and a roller assembly 144, the latter of which comprises a roller blank 146 and a roller shaft 148. As may be seen in the figures, the roller blank is of disc-shape outline and is recieved on the roller shaft. Preferably, the roller blank is received and secured centrally of the roller shaft by provision of a serrated surface or the equivalent. The roller assembly is supported within the cuts 92 and 94 of plunger head 84 as may be seen in FIGS. 1 and 2. Thus, the rectangular cut 92 not only will be of a depth to permit full receipt of the roller assembly, it will be of a width to accommodate movement of the roller blank therein. The cut 94 provides a bearing surface thereby to permit rotational movement of the roller assembly when acted upon by the cam 142. The roller shaft is formed by a steel rod and the roller blank may be of cold roll steel and suitably case hardened. The plunger head, likewise, is formed of steel and both the plunger head and the roller shaft may be nickel-plated to provide a good bearing surface.

The cam 142 is disc-shaped in outline including a tear-drop portion 152 at the center point along its camming surface. The cam 142 includes a central opening 154 to permit its receipt on shaft 114 and the opening is formed thereby to provide a lost motion connection between the shaft and the cam. Referring to FIG. 4, the opening 154 is substantially circular in outline including a pair of surfaces 156 and 158 which are of equal length thereby to intersect one another along a plane of symmetry of the cam.

Figure 3:
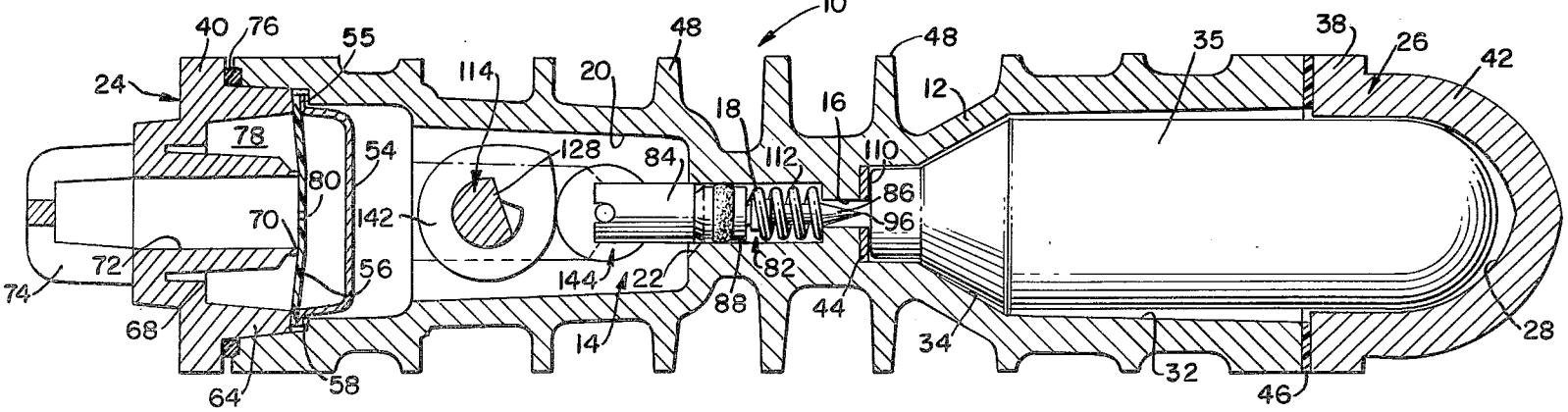
FIG. 3 is a view in section as seen along the line 3—3 in FIG. 2.
Figure 6:
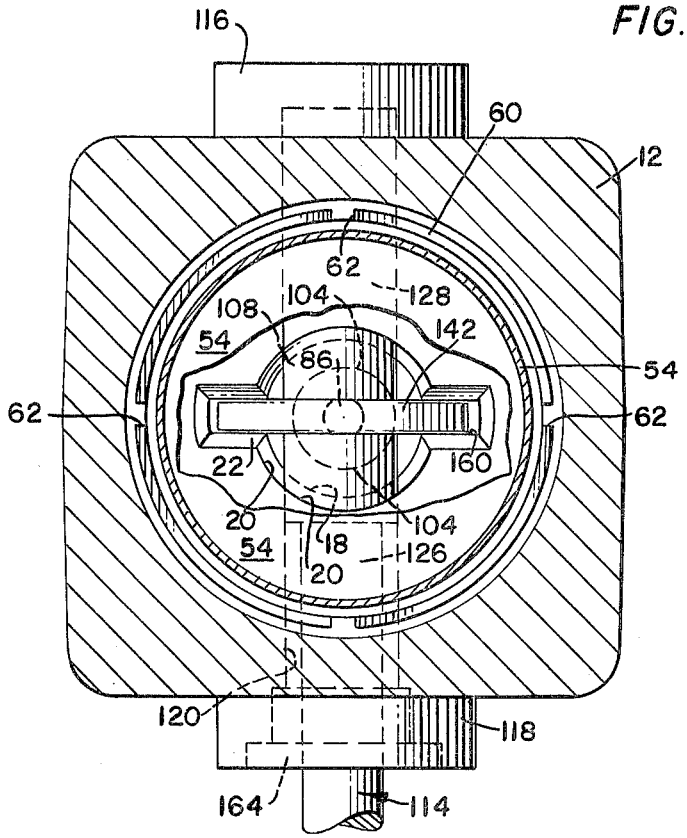
FIG. 6 is a view in section as seen along the line 6—6 in FIG. 2.

As may be seen in FIGS. 2, 3 and 6, both the cam 142 and the roller blank 146 are captive within a slot 160 throughout the end length 20 of opening 14. Thus, movement of the shaft 114 axially from the first to the second position and in return to the first position is relative to the cam. An O-ring 162 is received around the shaft 114 within the region of bore 124 thereby to provide a seal from the flow passage at this location. Each of the O-rings may be formed of rubber or a rubber substitute such as Buna-N. A stake member 164 may be received in the bore 124 to secure the O-ring in a sealing position.

Figure 5A:
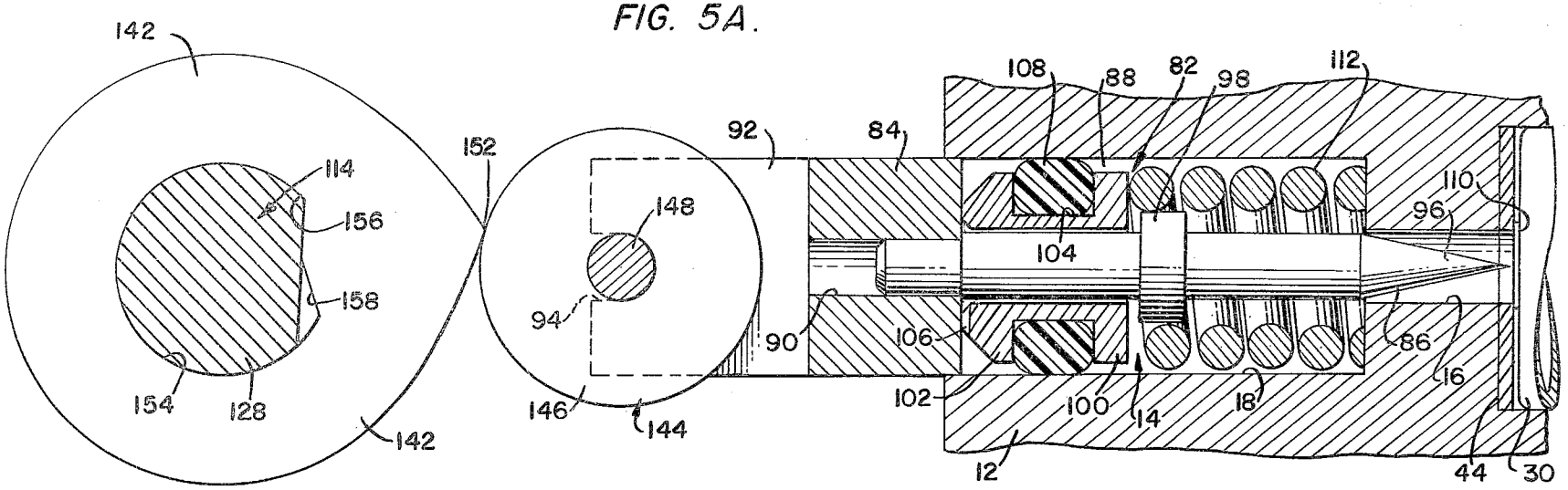
FIGS. 5A, 5B, 5C and 5D illustrate certain of the components of FIG. 4 in positions both prior to and after actuation of the intruder alarm by an unauthorized entry into a secured area.

In operation, and reference now may be had to FIGS. 5A, 5B, 5C and 5D, when shaft 114 is located in the second axial position, for example, the dotted line position in FIG. 10 thereby to be in cooperative relation to a bracket 166, movement of one member of a double-hung window, for example, relative to another member at a point of entry to a secured area will be transmitted to the arm 134 and, in turn, to the shaft 114 to cause it to rotate about its axis. The shaft initially will rotate relative to the cam throughout a small angle until a portion of the flat face of the length 128 of D-shaped cross-section abuts against either the surface 156 or 158 depending upon the orientation of structure and the predetermined direction of movement of the shaft. Further rotation of the shaft will cause following rotation of the cam and movement of both the roller assembly 144 and the plunger assembly 82 to the right as viewed in the Figures. By virtue of the fact that the roller blank is free to rotate, the movement of the roller assembly will be both rotational and longitudinal. The rotational movement capability serves to reduce the friction between the cam and roller blank thereby to reduce the necessary driving torque. FIG. 5A illustrates the plunger assembly and the roller assembly 144 in a position to the right of the normal position of rest of the plunger assembly and the cam 142 in a clockwise rotational position. In FIG. 5A, the plunger pin has moved to a position more closely adjacent the closure 110 of container 30 preparatory to its tip fracturing the closure to allow release of the pressurized contents. As previously discussed, the housing is sealed and accordingly the flow of fluid from the container will substantially follow through the opening 14 to the plenum chamber 78 of the sound generating structure, thereby to provide an audible signal indicative of unauthorized entry to the premises.

The orifice member 88 of plunger assembly 82 is of an overall length thereby to have a freedom of movement between a first and second stop portion represented by the plunger head 84 and the shoulder 98 of plunger pin 86, respectively. In FIG. 5A, it is to be noted that the orifice member 88 is in a position such that the annular surface of flange 102 is in abutting relation to the surface of plunger head 84. In this position of orientation, a maximum opening is provided between the flange 100 and the shoulder 98 and flow of fluid will be metered by the orifice 106.

It is an important aspect of the invention that the orifice member 88 be capable of movement between the first and second stop positions, as described above. Thus, in the operation of the intruder alarm debris in the form of particulate matter created upon fracture of the closure entrained with the escaping fluid flow will pass the orifice member and blow out of the housing through the passage 72. This will become clear as the description continues.

Figure 5B:
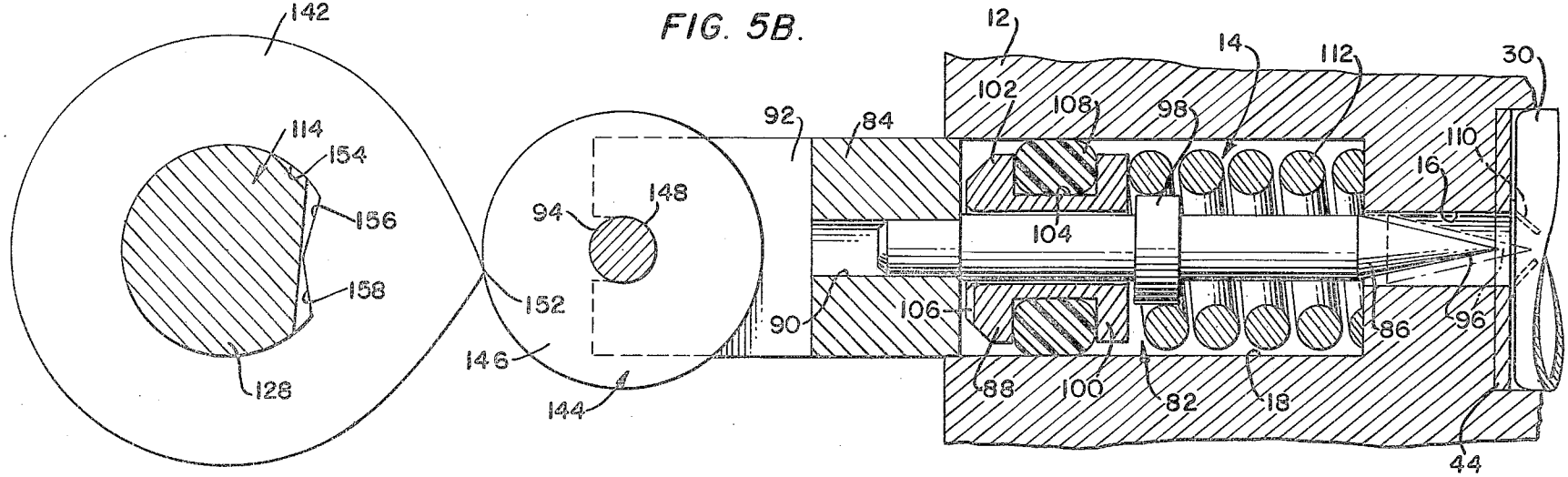
Figure 5C:
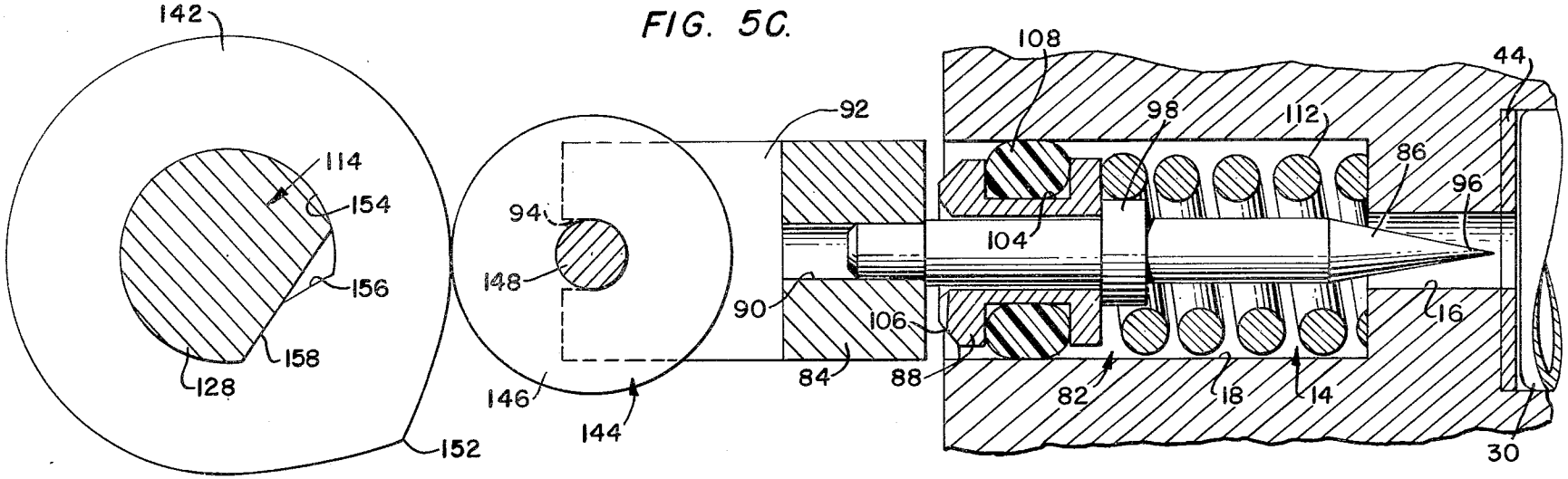
Figure 5D:
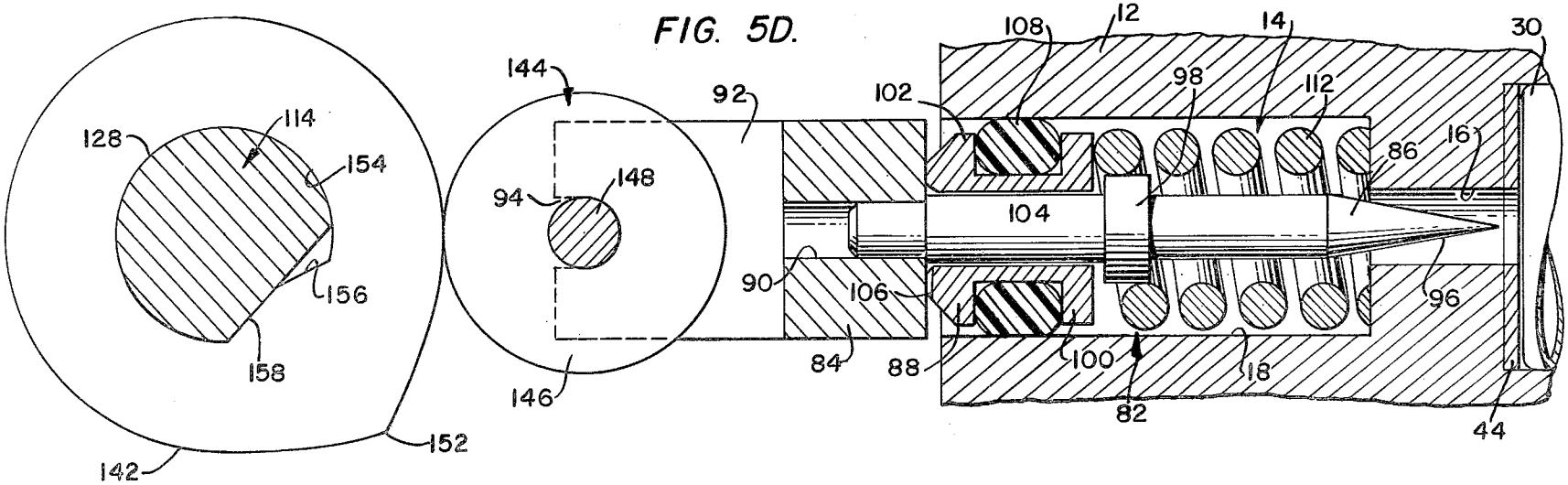

In FIG. 5B, the plunger assembly is illustrated in a position to which it will have returned from a position of maximum movement to the right after having fractured or broken through the closure 110. This condition of the closure is illustrated by the dotted line in FIG. 5B. As is apparent from FIG. 5B, the cam 142 has rotated so that the tear-drop portion 152 is beyond an overcenter position. This movement rotationally after having passed through the overcenter position is relative to that of shaft 114. The relative movement is illustrated by the small angular spacing between the surface 156 and the flat surface of the shaft. This capability of the structure results in the fulfillment of a second important aspect of the invention. To this end, movement of the cam in this manner permits the plunger pin 86 of the plunger assembly 82 to rapidly retract from the forward most piercing position to the position illustrated in FIG. 5B and ultimately the position of FIGS. 5C and 5D. The connection of the shaft 114 and cam 142 is a lost motion connection. Thus, as described, there is lost motion in rotational movement of the shaft 114 to the angular location of the cam 142 (FIG. 5A), but more importantly, there is lost motion in rotational movement of the cam 142 with respect to the shaft once the cam passes through the described overcenter position so that the cam rotates relative to the shaft to and beyond the position illustrated in FIG. 5B. In this manner the closure 110 of container 30 cannot be "teased" open as would be possible with a direct connection between these structures. The plunger assembly retracts primarily because of the force of the fluid rapidly exiting from the container, although the spring aids in the development of the return force. As may be appreciated in FIG. 5B, the plunger pin and plunger head retract more rapidly than does the orifice member such that the spacing between the upstream flange 100 of the orifice member and that of shoulder 98 goes from maximum spacing (FIG. 5A), through conditions of reduced spacing to a condition of no spacing at all (FIG. 5C) to maximum spacing (FIG. 5D). It is within the period time, which may be a few milliseconds in duration, represented by movement of the orifice member between the FIG. 5A and FIG. 5C positions, that the particulate debris entrained in the fluid flow passes beyond the orifice member 88.

FIG. 5D illustrates the position of the orifice member 88 after the passage of a few milliseconds time. In the position of FIG. 5D, the annular surface of flange 102 of the orifice member will abut against the plunger head. The return of the orifice member 88 to the FIG. 5D position has the effect of metering or throttling the fluid flow to a low pressure thereby to extend the period of the audible signal from the sound generating structure. The signal may be provided for a period of approximately 1 to 2 minutes having a sound intensity of about 90 db in the vicinity of the intruder alarm.

In operation of the intruder alarm through hundreds of tests, it has been found that the unique operation of the orifice member whereby it is capable of movement relative to the other components of the plunger assembly results in little or no build-up of debris in the form of particulate material within the flow passage and particularly the intermediate length 18. However, the orifice 106 is capable of extending by a metering or throttling action, the length of time during which the audible signal will be generated. The orifice may be of any particular dimension such as a V-shaped notch with perpendicular sidewalls and in the preferred embodiment the notch is cut to a depth of approximately 0.0050 inch.

As a further aspect of the invention, the cap 26 is formed of metal such as a zinc die cast or the equivalent thereby to act as a heat sink. To this end, and as was discussed, the recess 28 is of an outline closely conforming to that of the end of container 30 such that there is close contact between the cap and the container over a substantial region. Thus, the heat from the heat sink prevents the formation of dry ice within the container when the pressurized fluid is released. Freezing of the container and the stoppage of fluid flow would result in termination of the audible signal. The remaining outer components of the intruder alarm including the housing 12 and the horn 24 are formed of plastic and preferably one of the plastics which are capable of being molded and which have or provide characteristics of durability and long operating life. For example, the horn may be formed of a high-impact polystyrene while the housing may be formed of nylon or an equivalent material.

The structure heretofore described forms an intruder alarm having the unique capability of operating in a manner whereby the container of the pressurized medium cannot be "teased" open throughout a long interval of time, with the result that the escaping fluid is at a level of pressure in the plenum chamber 78 of the sound generating structure which is insufficient to generate an audible signal. Thus, upon unauthorized opening of a window or a door and rotational movement of arm 134 and shaft 114 through an angle, the cam 142 will follow the movement and concurrently with the action of release of the pressurized medium the cam will rapidly move through a further rotational angle independently of the shaft. This movement cannot be impeded by external forces. As the flow of fluid, once commenced, continues, a signal will be generated by the sound generating structure which is of an intensity and continues throughout a duration to provide a warning signal. Structure in the form of a plurality of ribs prevent the muting or muffling of the generated signal which may be in the range of intensity of about 90 db. The intruder alarm is provided with a heat sink around at least a portion of the container of pressurized fluid thereby to obviate the formation of dry ice using the fluid described herein. And, finally, the intruder alarm is provided with an orifice member which functions to allow at the first instant of flow of fluid the entrained particulate material to clear the housing then it functions to meter the flow of fluid to extend the audible signal over a period of about one to two minutes.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. An intruder alarm for providing a signal when actuated upon unauthorized entry into a secured area comprising:

(a) a housing having a flow passage, said housing adapted to be mounted on a first member, (b) a signaling means mounted on said housing at one end of said flow passage, said signaling means being responsive to a flow of fluid through said flow passage for providing said signal, (c) means for mounting a container enclosing a fluid under pressure isolated from the atmosphere by a closure member so that said closure member is juxtaposed to the other end of said flow passage, said mounting means received on said housing and having an internal wall surface substantially complementary to the outer wall surface of said container, (d) a plunger assembly disposed in said flow passage and movable from a first position toward said closure member, said assembly including (1) means for opening communication between said fluid and said flow passage so that said fluid is adapted to enter said flow passage, (e) an actuating means adapted for movement in response to movement of a second member upon an unauthorized entry into said secured area, and (f) means connecting said actuating means and said plunger assembly whereby upon said unauthorized entry to said secured area resulting in movement of said actuating means said plunger assembly is moved from said first position for opening said communication, said connecting means including a lost motion connection whereby said opening means of said plunger assembly is controlled in movement from said first position by said connecting means yet it retracts rapidly to said first position independently of movement of said connecting means to provide unobstructed entry of said fluid to said communicating flow passage.

2. The intruder alarm of claim 1 wherein said assembly includes an orifice member, said orifice member being received on said opening means and conjointly movable from said first position, said orifice member being movable relative to said opening means during a portion of said rapid retraction to allow any entrained particulate from said closure member to clear said flow passage, and said orifice member including an orifice for metering flow of fluid when said orifice member is in said first position.

3. The intruder alarm of claim 2 including sealing means and wherein said orifice member includes a central bore, said sealing means being supported on said orifice member to seal and space between the supporting surface and the surface of said flow passage to provide for all fluid flow to be through said central bore.

4. The intruder alarm of claim 1 wherein said assembly includes an orifice member, said orifice member comprising a body of spool-like outline, a head member, and a sealing member received around said body for sealing the space between said body and the wall of said communicating flow passage, said opening means defined by an elongated rod having a piercing tip at one end and a shoulder between said piercing tip and the other end, said head member received on said rod other end and said body received on said rod for movement between said shoulder and said head member, and said orifice member including an orifice for metering said fluid flow from said source through said body.

5. The intruder alarm of claim 4 wherein said body includes an extension in the direction of flow of fluid terminating in an annular wall disposed outwardly of the surface of said rod, and wherein said orifice includes a notch through said extension.

6. The intruder alarm of claim 4 including spring means acting between said housing and said orifice member for biasing said assembly to said first position.

7. The intruder alarm of claim 4 wherein said assembly moves as a unit from said first position and both said elongated rod and head member retract more rapidly than said orifice member to allow non-metered fluid flow for a period of time for passage of debris from said closure member to clear said flow passage.

8. The intruder alarm of claim 1 wherein said actuating means includes an elongated shaft and an actuating arm, means for mounting said actuating arm on one end of said elongated shaft in a plurality of different angular positions, said elongated shaft adapted to be moved longitudinally between a first and second position, means for restraining rotational movement of said elongated shaft when in said first position, and said elongated shaft when in said second position operative to be rotated about its axis in response to movement of a window, door or other movable member comprising a barrier to said secured area.

9. The intruder alarm of claim 8 wherein said other end of said elongated shaft terminates in a non-circular cross-section, and said restraining means comprises a recess in said housing of complementary non-circular cross-section.

10. The intruder alarm of claim 1 wherein said actuating means is movable longitudinally from an inoperative to an operative position thereby being adapted for rotary movement in response to said unauthorized entry to said secured area, and wherein said connecting means includes a cam member adapted for rotary movement, said cam member received on said actuating means through said lost motion connection.

11. The intruder alarm of claim 10 wherein said actuating member includes a length of D-shape cross-section and said cam member is of symmetrical tear-drop outline, said cam member having a bore including a portion complementary to the arcuate outline of said actuating member and a portion formed by two flat surfaces of equal length intersecting within a plane bisecting said cam member whereby upon rotation of said actuating member its flat surface will move into contact with one or the other of the cam member flat surface to rotate said cam member and drive said assembly from said first position, and when said cam member moves past an overcenter position it snaps forwardly of said actuating member to permit said rapid retraction of said assembly.

12. The intruder alarm of claim 10 wherein said connecting means further includes a disc and said assembly further includes a head member, said head member being carried by and movable with said opening means, and means supporting said disc on said head member in position so that said cam member operates along the peripheral surface.

13. The intruder alarm of claim 1 wherein said signaling means includes a horn having a mouth for communicating said flow passage to the atmosphere, a diaphragm, a resonating chamber, and means for supporting both said diaphragm and resonating chamber across said flow passage, said supporting means providing flow communication around said diaphragm whereby said diaphragm vibrates against said mouth to generate an audible signal.

14. The intruder alarm of claim 1 wherein said source of fluid under pressure includes a container and said closure member includes a frangible member closing said container, and said fluid comprises carbon dioxide.

* * * * *